US005855239A

United States Patent [19]

Iwamoto et al.

[11] Patent Number: 5,855,239

[45] Date of Patent: Jan. 5, 1999

[54] METHOD FOR CONTROLLING INJECTION OF DIE CASTING MACHINE

[75] Inventors: Norihiro Iwamoto, Sagamihara; Hiroshi Yokoyama, Zama; Tai Matsuda, Kawasaki, all of Japan

[73] Assignee: Toshiba Kikai Kabushiki Kaisha, Japan

[21] Appl. No.: 769,925

[22] Filed: Dec. 9, 1996

Related U.S. Application Data

[63] Continuation-in-part of Ser. No. 378,281, Jan. 26, 1995, abandoned.

[30] Foreign Application Priority Data

Jan. 28, 1994 [JP] Japan ..... 6-8648

[51] Int. Cl.[6] ..... B22D 17/10

[52] U.S. Cl. ..... 164/457; 164/113

[58] Field of Search ..... 164/113, 312, 164/315, 457, 155.4

[56] References Cited

FOREIGN PATENT DOCUMENTS 28 54 075 1/1980 Germany .
57-202956 12/1982 Japan .
58-179555 10/1983 Japan .
58-173068 11/1983 Japan .
58-224061 12/1983 Japan .
7-214282 8/1995 Japan .
1733189 5/1992 U.S.S.R. .

*Primary Examiner*—Kuang Y. Lin
*Attorney, Agent, or Firm*—Cushman Darby & Cushman Intellectual Property Group of Pillsbury Madison & Sutro, LLP

[57] ABSTRACT

A method for controlling the injection of a die casting machine in which immediately after molten metal is injected into a cavity of metal molds at a high speed, the pressure oil in the chamber at the rod side of an injection cylinder is discharged into a tank side to commence the increase in pressure. A reference point for a switching-over position where a high speed charge is switched over to the increase in pressure is determined by computing a necessary length along the path for keeping the increased charging pressure on the basis of the supplied molten metal quantity during the previous injection process and subtracting the length from the length between the starting position and the position of limit of the forward movement at the previous injection process.

4 Claims, 3 Drawing Sheets

METHOD FOR CONTROLLING INJECTION OF DIE CASTING MACHINE

This is a continuation-in-part of application Ser. No. 08/378,281, filed Jan. 26, 1995, now abandoned, the disclosure of which is incorporated herein by this reference.

FIELD OF THE INVENTION

The present invention relates to a method for controlling the injection of a die casting machine which allows an increase in pressure to occur immediately after molten metal within a plunger sleeve is charged into a cavity within metal molds.

BACKGROUND OF THE INVENTION

FIG. 4 is a diagram for explaining an injection control in a conventional die casting process. The injection control is divided into three steps: a step of charging molten metal at a low speed VI after the molten metal is poured into the plunger sleeve, a step of charging the molten metal into the cavity at a high speed, and a last step of performing an increase in pressure immediately after charging the molten metal into the cavity.

In the high speed charge of molten metal among these steps, a so-called run-around system is adopted which enables pressure oil in the rod side chamber of an injection cylinder to be circulated to the head side chamber, thereby performing a movement of injection at a high speed using a lower quantity of flow of pressure oil.

Further, in the increased pressure control after the charge, pressurizing the molten metal charged into the cavity as soon as possible is indispensable for providing a high quality of flawless casting.

In the prior art, a reference point for calculating a valve switching-over point where a run-around control is switched over to a quick pressure control is taken at a position 0 of starting of the movement in a stroke of the injection cylinder, and the switching-over positon is set to a position at a predetermined distance from the position of limit of the backward movement. A position detector such as a limit switch is provided at the switching-over position, and the control valve is switched over on the basis of a detecting signal from the position detector.

In a die casting process, the existence of dispersion in the swing angles of the ladle often causes a change in a supplied quantity of molten metal. From this reason, in the case where the reference point of switching-over from a high speed control to a quick increased-pressure control is taken to a starting position of the movement of the injection cylinder, the positions where the increase in pressure is actually commenced are different in a relation relative to a high speed injection control.

In this case, when the switching-over operation is performed at a position short of the switching-over position set as an optimum position L, the high speed injection is throttled and a braking action is inconveniently applied.

On the other hand, when the switching-over operation is performed at a position behind the set position, a delay occurs in the increase in pressure, which exerts an influence on the quality of a product.

SUMMARY OF THE INVENTION

An object of the invention is to solve the problems in the above-mentioned prior arts and to provide a method for controlling the injection of a die casting machine in which a timing when switching-over to an increase in pressure after molten metal is injected into a cavity at a high speed is made constant, and which allows an increase in pressure to be commenced immediately after a charge of molten metal.

In order to achieve the above-mentioned object, according to the present invention, there is provided a method for controlling the injection of a die casting machine, comprising the steps of:

providing a plunger sleeve and a plunger tip slidably inserted within the plunger sleeve;

measuring molten metal quantity supplied during an already performed previous injection process and a position of limit of the forward movement of said plunger tip and determining a second predetermined position of the movement of said plunger tip on the basis of the measurement;

pouring molten metal into said plunger sleeve;

moving said plunger tip at a first speed along a path from a starting position thereof to a first predetermined position for charging the molten metal into a metal mold cavity at said first speed at a charging pressure;

moving said plunger tip along said path at a second speed higher than said first speed when said plunger tip has reached the first predetermined position for charging the molten metal into the metal mold cavity at said second speed;

increasing the charging pressure of said molten metal by said plunger tip when said plunger tip is moved to said second predetermined position; and keeping the increased charging pressure of said molten metal while the plunger tip is moving along said path from said second predetermined position to the position of limit of the forward movement of said plunger tip.

In the above mentioned control method, the second predetermined position is determined by computing a necessary length along said path for keeping the increased charging pressure on the basis of the supplied molten metal quantity during said previous injection process and subtracting said length from the length between said starting position and the position of limit of the forward movement at said previous injection process.

Further, the second predetermined position is determined on the basis of an average value of measurements of the supplied molten metal quantity and the position of limit of the forward movement of the plunger tip during a plurality of already performed previous injection process.

In the above mentioned control method, the method further comprising:

providing an oil cylinder having a rod connected to said plunger tip;

providing an oil tank connected at the rod side of said oil cylinder;

supplying pressure oil into said oil cylinder for moving said plunger tip within said plunger sleeve; and discharging said pressure oil in said oil cylinder rod side to said oil tank during the process of keeping the increased charging pressure of said molten metal.

According to the present invention, the increase in pressure to be always commenced at a constant timing without depending on the fluctuation of a position of stoppage of the plunger due to an exchange of the molds or on the fluctuation of a condition of supplying molten metal such as a continuous decrease in the supplied quantity of molten metal due to a fall of the surface level of the supplied molten metal. In addition, correcting the point of commencing the increase in pressure by a delay time of the switching-over movement of the control valve allows the pressure oil in the chamber at the rod side of the injection cylinder to be released so as to be discharged into a tank immediately after the charge and, accordingly, a pressure can be applied to the molten metal immediately after the switching-over operation from the speed control.

BRIEF DESCRIPTION OF THE DRAWINGS

Other objects and aspects of the invention will become apparent from the following description of an embodiment with reference to the accompanying drawings in which.

PREFERRED EMBODIMENT OF THE INVENTION

One embodiment of the present invention will be explained with reference to the accompanying drawings.

Figure 1:
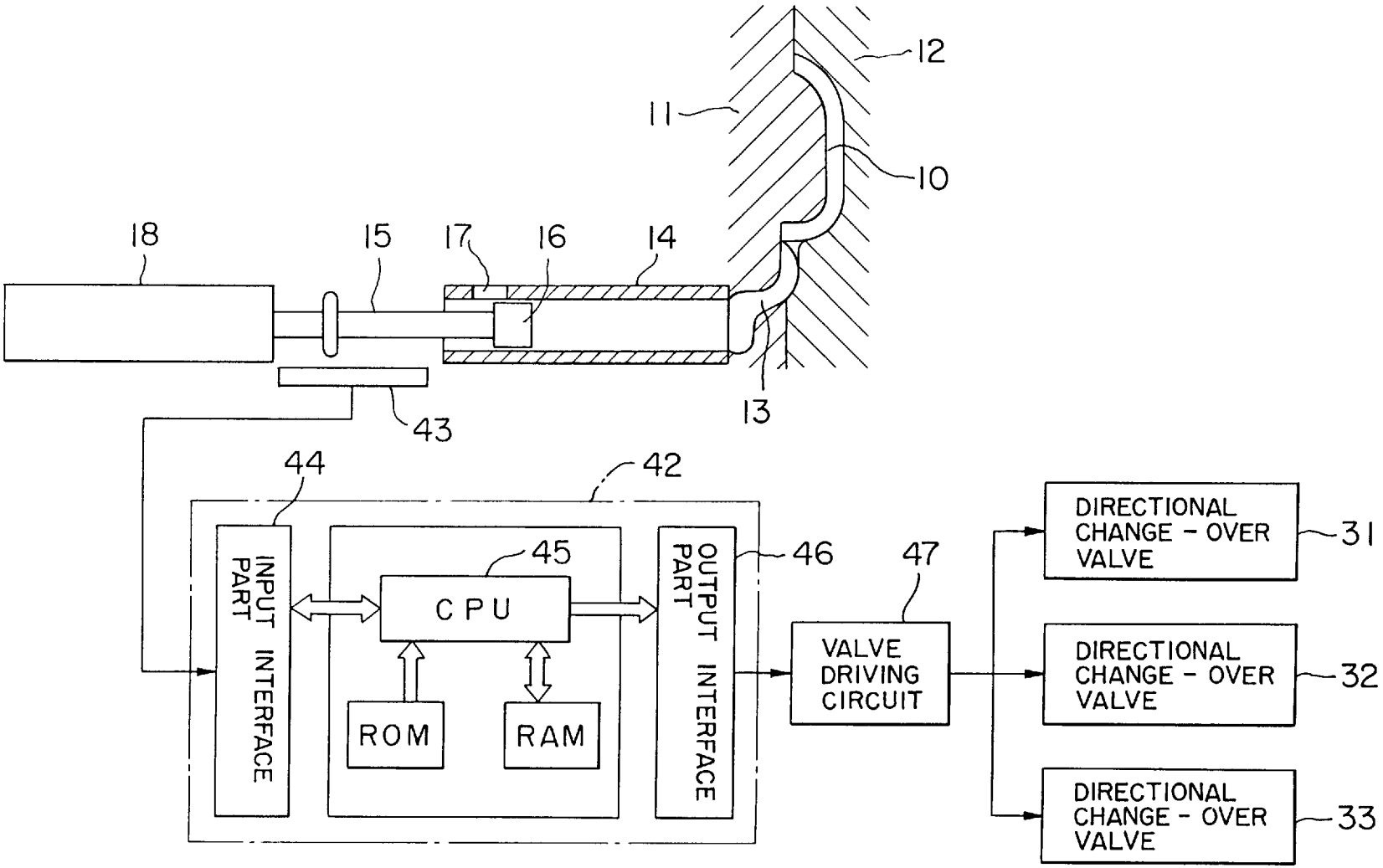
FIG. 1 is an explanative view showing the construction of an apparatus for carrying out the injection control according to the present invention.

Referring to FIG. 1, reference character 10 indicates a cavity which is formed by metal molds 11 and 12. Further, the cavity 10 communicates with a plunger sleeve 14 through a runner 13.

The plunger tip 16 of an injection plunger 15 is slidably fitted in the plunger sleeve 14, and molten metal poured from a pouring port 17 using a ladle (not shown) is pressurized by the plunger tip 16, which is being moved forward, and is forced into the cavity under pressure.

Figure 2:
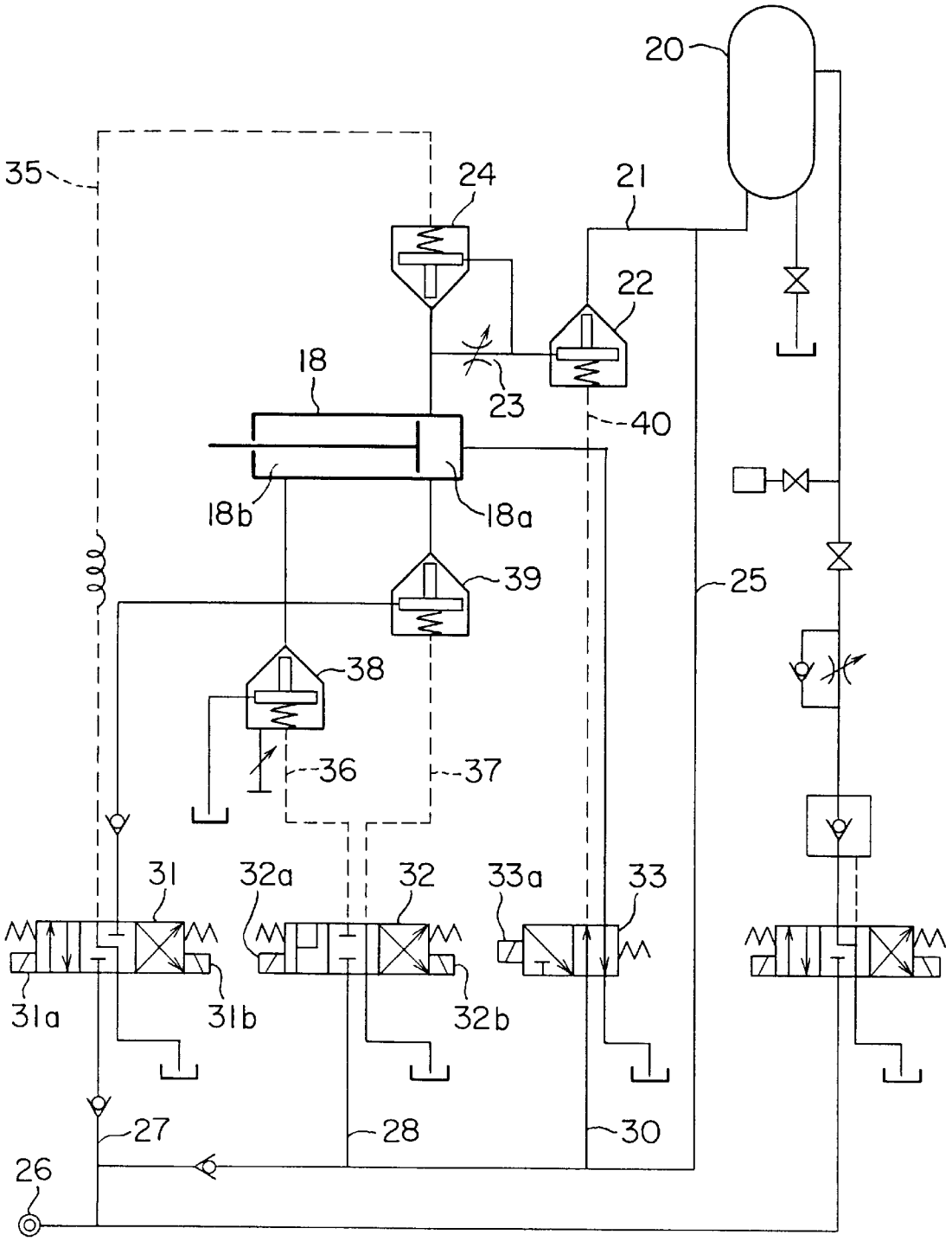
FIG. 2 is a circuit diagram of a hydraulic circuit for controlling an injection cylinder.

An injection cylinder 18 which drives the injection plunger 15 is controlled by a hydraulic control circuit shown in FIG. 2.

Referring to FIG. 2, reference character 20 indicates an accumulator in which the energy of pressure oil is accumulated, and pressure oil is supplied into the cylinder chamber 18*a* at the head side of the injection cylinder 18 by way of a pipe line 21. The pipe line 21 is provided with a high speed cut-off valve 22, and the downstream of the high speed cut-off valve 22 branches into two lines which are provided with a variable throttle valve 23 and a high speed cut-off valve 24, respectively. When the injection cylinder 18 is actuated at a low speed, the high speed cut-off valve 24 is closed and pressure oil is supplied to the cylinder chamber 18*a* through the variable throttle valve 23, and when it is actuated at a high speed, the high speed cut-off valve 24 is opened so that a large flow rate of pressure oil is supplied to the cylinder chamber 18*a*.

Further, pressure oil is supplied to the above-mentioned accumulater 20 from a hydraulic source 26 by way of a hydraulic supply pipe line 25.

Meanwhile, pipe lines 27, 28 and 30, to which pressure oil is supplied from the hydraulic source 26, are provided with a first electromagnetic directional change-over valve 31, a second electromagnetic directional change-over valve 32 and a third electromagnetic directional change-over valve 33.

The above-mentioned first electromagnetic directional change-over valve 31 is a change-over valve for controlling the action of the injection cylinder 18, and when the injection cylinder 18 is actuated at a low injection speed, the injection solenoid 31*a* is excited so that a pilot pressure acts on the high speed cut-off valve 24 from a pilot pressure line 35 to thereby close the high speed cut-off valve 24. When the solenoid 31*b* is excited, pressure oil is supplied to the cylinder chamber 18*b* at the rod side of the injection cylinder 18 to thereby move the injection plunger 15 backward.

The above-mentioned second electromagnetic directional change-over valve 32 is a change-over valve which performs a switching-over operation to a run-around control for circulating the pressure oil in the cylinder chamber 18*b* at the rod side of the injection cylinder 18 to the cylinder chamber 18*a* at the side opposite the rod side and which performs a switching-over operation of the injection control from a speed control to a pressure control. To the second directional change-over valve 32 are connected a high speed cut-off valve 38 and a high speed cut-off valve 39 through pilot pressure lines 36 and 37, respectively, said high speed cut-off valve 38 performing discharging the pressure oil in the cylinder chamber 18*b* at the rod side into the tank side and said high speed cut-off valve 39 performing causing the cylinder chamber 18*a* at the side opposite the rod side to communicate with the cylinder chamber 18*b* at the rod side.

Moreover, the third electromagnetic directional change-over valve 33 is a change-over valve for switching over the flow rate of the pressure oil supplied from the accumulater 20 to the injection cylinder 18. To the third electromagnetic directional change-over valve 33 is connected a high speed cut-off valve 22 through a pilot pressure line 40.

Referring now to FIG. 1, reference character 42 indicates a control part for controlling the opening and closing operations of the above-mentioned first to third electromagnetic directional change-over valves 31, 32 and 33. In this control part 42 is arranged a position detecting means 43 for detecting a position of a position indicating part 16*a* which is attached to the plunger tip 16.

This position detecting means 43 is a senser which detects a continuous, linear position of the plunger tip 16, and the output of the senser is inputted into a central processing unit 45 by way of an input interface part 44.

The central processing unit 45 operates according to a program in which a procedure of process of the injection control is described, and outputs the signals of opening and closing the valves to a valve driving circuit 47 by way of an output interface part 46. The solenoids of the above-mentioned first to third electromagnetic directional change-over valves 31, 32 and 33 are driven and controlled by means of the valve driving circuit 47.

Figure 3:
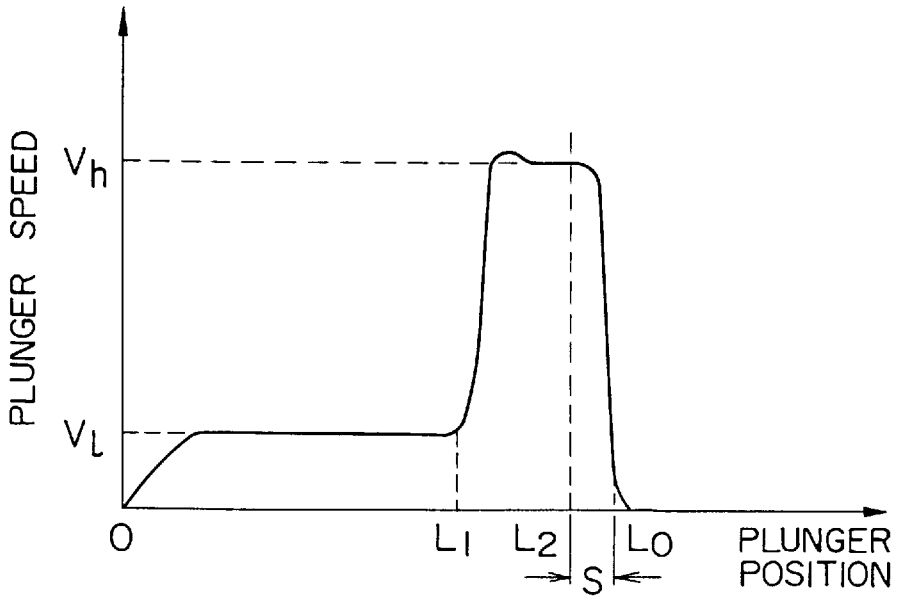
FIG. 3 is a diagram showing a relation between the position and the speed of an injection plunger in the injection control according to the present invention.
Figure 4:
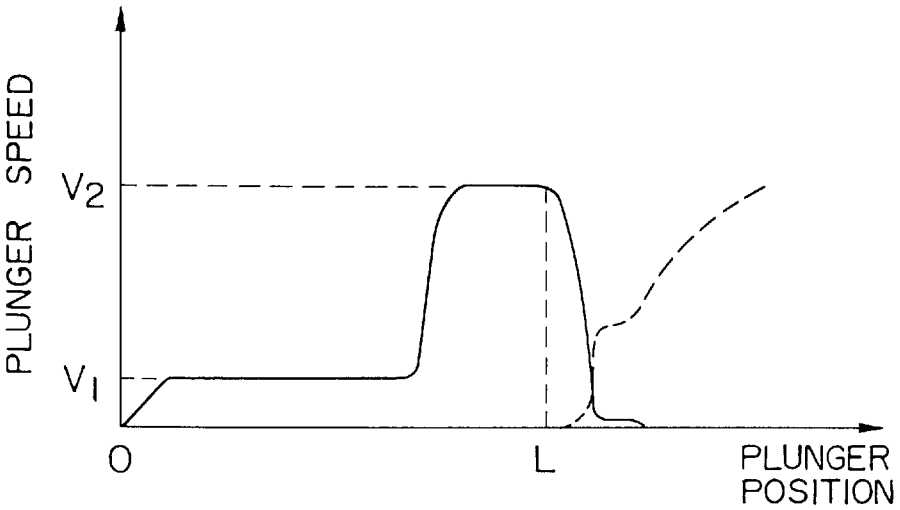
FIG. 4 PRIOR ART
FIG. 4 is a diagram showing a relation between the position and the speed of an injection plunger in the conventional injection control.

FIG. 3 is a diagram showing a relation between the position and speed of the plunger tip 16 during a process of the injection control according to the present embodiment.

An operation of switching-over from a low injection speed Vl to a high injection speed Vh is performed when the plunger tip 16 reaches a predetermined position L1 which is determined from a casting condition. This position is adapted to be detected by means of the above-mentioned position detecting means 43. Further, the position of the high speed control being switched over to an increased pressure control after molten metal is charged into the cavity 10 is determined in such a manner that an increase in pressure is commenced when the plunger 16 reaches a position L2. The position L2 is determined by computing a necessary length S along the path for keeping the increased charging pressure on the basis of the supplied molten metal quantity during the previous injection process and subtracting the length S from the length between the starting position 0 and the position L0 of limit of the forward movement at the previous injection process. The origin L0 which is a basis for determining the position L2 of commencing the increase in pressure, is taken at a position of limit of the forward movement where the plunger tip would reach when the charge of the molten metal is completed, and for the position of the origin L0, a value is used which is predicted on the basis of a supplied quantity of molten metal or which is calculated by processing statistically the measured data of the position of limit of the forward movement in a casting cycle on a condition similar to the actual condition. For example, the position of the reference point L0 is determined by measuring the supplied quantity of the molten metal and the forward position of the plunger tip 16 at each times of the high speed charge process is ended, storing the measured data into the memory means of the control part 42 and calculating the mean value of these data.

Moreover, a value of the section length S is set depending on a casting condition, but is determined by correcting the set value taking into consideration a period of time from a time when a switching-over signal is actually outputted to the control valve on the basis of the set value to a time when the valve is changed over. In this connection, the value of the section length S may be changed so that a proper time for a rise in pressure is provided in the case where a time lag at the time of a rise in pressure or a defective rise in pressure occurs as a result of the injection control. The central processing unit 45 of the control part 42 calculates the position of commencing an increase in pressure from the position of the reference point L0 which is previously stored, and detects from the output of the position detecting means 43 that the plunger tip 16 has reached the position of commencing an increase in pressure, outputting a signal for commencing an increase in pressure to the valve driving circuit 47. The actual injection control will now be explained with reference to FIG. 2.

When a casting cycle is commenced, molten metal is pressed into the cavity 10 at a low injection speed VI. In a process of the low speed injection, the solenoid 31*a* of the first electromagnetic directional change-over valve 31 in FIG. 2 is excited and the high speed cut-off valve 24 is closed by a pressure supplied from the pilot pressure line 35. Further, the solenoid 32*a* of the second electromagnetic directional change-over valve 32 is excited and the high speed cut-off valves 38 and 39 are closed by a pilot pressure applied thereto. The solenoid 33*a* of the third electromagnetic directional change-over valve 33 is excited and no pilot pressure is applied to the high speed cut-off valve 22, which is accordingly opened. The pressure oil accumulated in the accumulator 20 is therefore supplied to the cylinder chamber 18*a* at the rod side of the injection cylinder 18 by way of a variable throttle valve 23, so that the injection cylinder 18 performs a movement of injection at a low speed.

The injection plunger 18 is moved forward at a low speed and reaches the position L1 where the low speed injection is switched over to the high speed injection.

That position is detected by means of the position detecting means 43. The first electromagnetic directional change-over valve 31 is demagnetized in its solenoid 31*a* to thereby restore its neutral position, and the second electromagnetic directional change-over valve 32 is also demagnetized in its solenoid 32*a* to thereby restore its neutral position. As a result, a large quantity of pressure oil is supplied into the cylinder chamber 18*a* at the head side of the injection cylinder 18 from the accumulator 20 through the high speed cut-off valve 24 which is opened into the pilot line 35 and, simultaneously, no pilot pressure comes to act on the high speed cut-off valve 39 which allows the cylinder chamber 18*b* at the rod side and the cylinder chamber 18*a* at the head side to communicate with each other, so that along with forward movement of the plunger, working oil is circulated from the rod side to the head side of the injection cylinder 18, thereby allowing the injection plunger 18 to perform an injection movement at a high speed Vh.

When the plunger tip 16 reaches the predetermined position L2, the solenoid 32*b* of the second electromagnetic change-over valve 32 is excited to forcibly close the high speed cut-off valve 39 by the pilot pressure, so that working oil is not circulated from the cylinder chamber 18*b* at the rod side into the cylinder chamber 18*a* at the head side, thus a run-around mode is shifted to a pressure control mode. In this case, since the high speed cut-off valve 38 is not subjected to a pilot pressure and is accordingly opened, working oil in the cylinder chamber 18*b* at the rod side is released so as to be discharged into the tank through the high speed cut-off valve 38, thereby immediately allowing a high pressure to be applied to the molten metal charged into the cavity 10.

In this way, the position L2 where the injection speed control is switched over to the pressure control is determined by computing a necessary length S along the path for keeping the increased charging pressure on the basis of the supplied molten metal quantity during the previous injection process and subtracting the length from the length between the starting position 0 and the position L0 of limit of the forward movement at the previous injection process. Therefore, an increase in pressure can always be commenced with a constant timing after completion of the charge, not depending on a change in a supplied quantity of molten metal due to the fluctuation of the level surface of molten metal such as a change in the position of limit of the forward movement when the metal molds are exchanged.

As is apparent from the above-mentioned explanation, in the present invention pressure oil in the chamber at the rod side of said injection cylinder is discharged into a tank side to commence an increase in pressure, at a point of a plunger tip being reached the predetermined position which is determined by computing data on the basis of the previous injection process. Consequently, since a timing when a high speed control is switched over to the increase in pressure after molten metal is injected into the cavity at a high speed is made constant, and the increase in pressure is commenced immediately after the charge, the present invention greatly contributes to the stabilization and improvement of the quality of castings.

What is claimed is:

1. A method of controlling an injection process of a die casting machine comprising the steps of:

providing a plunger sleeve and a plunger tip slidably inserted within the plunger sleeve;

measuring molten metal quantity supplied during an already performed previous injection process and a position of limit of the forward movement of said plunger tip and determining a second predetermined position of the movement of said plunger tip on the basis of the measurement;

pouring molten metal into said plunger sleeve;

moving said plunger tip at a first speed along a path from a starting position thereof to a first predetermined position for charging the molten metal into a metal mold cavity at said first speed at a charging pressure;

moving said plunger tip along said path at a second speed higher than said first speed when said plunger tip has reached the first predetermined position for charging the molten metal into the metal mold cavity at said second speed;

increasing the charging pressure of said molten metal by said plunger tip when said plunger tip is moved to said second predetermined position; and keeping the increased charging pressure of said molten metal while the plunger tip is moving along said path from said second predetermined position to the position of limit of the forward movement of said plunger tip.

2. The method according to claim 1 wherein said second predetermined position is determined by computing a necessary length along said path for keeping the increased charging pressure on the basis of the supplied molten metal quantity during said previous injection process and subtracting said length from the length between said starting position and the position of limit of the forward movement at said previous injection process.

3. The method according to claim 1 wherein said second predetermined position is determined on the basis of an average value of measurements of the supplied molten metal quantity and the position of limit of the forward movement of the plunger tip during a plurality of already performed previous injection process.

4. The method according to claim 1 wherein said method further comprising:

providing an oil cylinder having a rod connected to said plunger tip;

providing an oil tank connected at the rod side of said oil cylinder;

supplying pressure oil into said oil cylinder for moving said plunger tip within said plunger sleeve; and discharging said pressure oil in said oil cylinder rod side to said oil tank during the process of keeping the increased charging pressure of said molten metal.

* * * * *